US010224653B2

(12) United States Patent
Niu et al.

(10) Patent No.: US 10,224,653 B2
(45) Date of Patent: Mar. 5, 2019

(54) CARD EDGE CONNECTOR HAVING KEY EQUIPPED WITH METALLIC PROTECTIVE CAP SECURED TO HOUSING

(71) Applicant: FOXCONN INTERCONNECT TECHNOLOGY LIMITED, Grand Cayman (KY)

(72) Inventors: Guo-Xiang Niu, Kunshan (CN); Jian Zhang, Kunshan (CN); Xin-Wei Wang, Kunshan (CN); Zhuang Chen, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/717,060

(22) Filed: Sep. 27, 2017

(65) Prior Publication Data

US 2018/0090864 A1 Mar. 29, 2018

(30) Foreign Application Priority Data

Sep. 27, 2016 (CN) ..... 2016 1 0851574

(51) Int. Cl.

| | |
|---|---|
| ***H01R 12/72*** | (2011.01) |
| ***H01R 12/73*** | (2011.01) |
| ***H01R 13/64*** | (2006.01) |
| ***H01R 13/645*** | (2006.01) |
| *H01R 12/71* | (2011.01) |
| *H01R 13/6594* | (2011.01) |

(52) U.S. Cl.

CPC ..... *H01R 12/721* (2013.01); *H01R 12/737* (2013.01); *H01R 13/64* (2013.01); *H01R 13/645* (2013.01); *H01R 12/716* (2013.01); *H01R 13/6594* (2013.01)

(58) Field of Classification Search

CPC ..... H01R 13/64; H01R 13/73; H01R 12/73; H01R 12/62; H01R 12/7217

USPC ..... 439/377, 59, 62, 630, 633

See application file for complete search history.

(56) References Cited

U.S. PATENT DOCUMENTS 5,035,631 A * 7/1991 Piorunneck ..... H01R 23/688 439/108

5,336,111 A * 8/1994 Thrush ..... H01R 12/7064 439/567

(Continued)

FOREIGN PATENT DOCUMENTS

CN 2845210 Y 12/2006

CN 205429312 U 8/2016

*Primary Examiner* — Tulsidas C Patel

*Assistant Examiner* — Peter G Leigh

(74) *Attorney, Agent, or Firm* — Wei Te Chung; Ming Chieh Chang

(57) ABSTRACT

An electrical card edge connector for receiving an electronic card with a bottom notch therein, includes an insulative housing, a plurality of terminals and an alignment key. The housing includes two opposite side walls, a bottom wall and a central slot among the side walls and the bottom wall. The terminals are disposed in the corresponding side walls and extend into the central slot for mating with the electronic card. The alignment key includes a body received within the central slot, a pair of extension sections covering the two side walls, and a pair of securing sections attached to the bottom wall wherein the body is adapted to be received within the bottom notch of the electronic card.

14 Claims, 14 Drawing Sheets

(56) References Cited

U.S. PATENT DOCUMENTS 5,387,115 A * 2/1995 Kozel ..... H01R 12/712 439/157
5,449,297 A * 9/1995 Bellomo ..... H01R 12/7023 439/630
6,017,248 A * 1/2000 Pan ..... H01R 12/7005 439/681
6,086,416 A * 7/2000 Choy ..... H01R 12/707 439/567
6,152,777 A * 11/2000 Smith ..... H01R 13/6456 200/506
6,168,450 B1 * 1/2001 Davis ..... H05K 7/1431 439/325
6,203,338 B1 * 3/2001 Choy ..... H01R 12/721 439/83
6,358,079 B1 * 3/2002 Noble ..... H01R 12/7005 439/326
6,435,905 B1 * 8/2002 Yu ..... H01R 12/7029 439/567
6,638,105 B1 * 10/2003 Wu ..... H01R 12/7029 439/567
6,648,682 B1 * 11/2003 Wu ..... H01R 12/7029 439/374
6,726,492 B1 * 4/2004 Yu ..... H01R 23/688 434/74
7,001,212 B1 * 2/2006 Juntwait ..... H05K 3/301 439/566
7,052,286 B2 * 5/2006 Zhang ..... H01R 43/0256 439/74
7,108,554 B2 * 9/2006 Huang ..... H01R 23/6873 439/378
7,347,725 B2 * 3/2008 Sakamoto ..... H05K 3/301 439/566
7,442,093 B2 * 10/2008 Li ..... H01R 12/721 439/633
7,491,092 B2 * 2/2009 Zhu ..... H01R 13/6456 439/633
7,883,344 B1 * 2/2011 Felton ..... H01R 13/506 439/135
7,972,171 B2 * 7/2011 Teh ..... H01R 12/7064 439/329
8,133,063 B2 * 3/2012 Tay ..... H01R 13/447 439/83
8,157,576 B2 * 4/2012 Fu ..... H01R 12/721 439/153
8,535,077 B2 * 9/2013 Shen ..... H01R 12/737 439/160
9,570,823 B2 * 2/2017 Lai ..... H01R 12/716
9,634,430 B1 * 4/2017 Yu ..... H01R 13/6275
2007/0155245 A1 * 7/2007 Tsai ..... H01R 12/7005 439/637
2015/0162685 A1 * 6/2015 Tanaka ..... H01R 12/737 439/630
2016/0013589 A1 * 1/2016 Fu ..... H01R 12/7005 439/157

* cited by examiner

CARD EDGE CONNECTOR HAVING KEY EQUIPPED WITH METALLIC PROTECTIVE CAP SECURED TO HOUSING

BACKGROUND OF THE INVENTION

1. Field of the Invention

The present invention relates to a card edge connector, and particularly to the card edge connector with a reinforced metallic key within the central slot in which the electronic card is received.

2. Description of Related Art

Chinese Patent No. CN205429312 discloses an electrical card edge connector equipped with a key within the central slot, which receives the bottom edge of the corresponding electronic card, for the orientation purpose. Anyhow, such a key is secured to the housing via the barbed structure, thus resulting in significant impact during assembling. In addition, the key has its own mounting leg, thus requiring rearrange the layout of the printed circuit board on which the connector is mounted. Therefore, a new design for the corresponding card edge connector is desired.

SUMMARY OF THE INVENTION

An electrical card edge connector for receiving an electronic card with a bottom notch therein, includes an insulative housing, a plurality of terminals and an alignment key. The housing includes two opposite side walls, a bottom wall and a central slot among the side walls and the bottom wall. The terminals are disposed in the corresponding side walls and extend into the central slot for mating with the electronic card. The alignment key includes a body received within the central slot, a pair of extension sections covering the two side walls, and a pair of securing sections attached to the bottom wall wherein the body is adapted to be received within the bottom notch of the electronic card.

DETAILED DESCRIPTION OF THE PREFERRED EMBODIMENT

Figure 1:
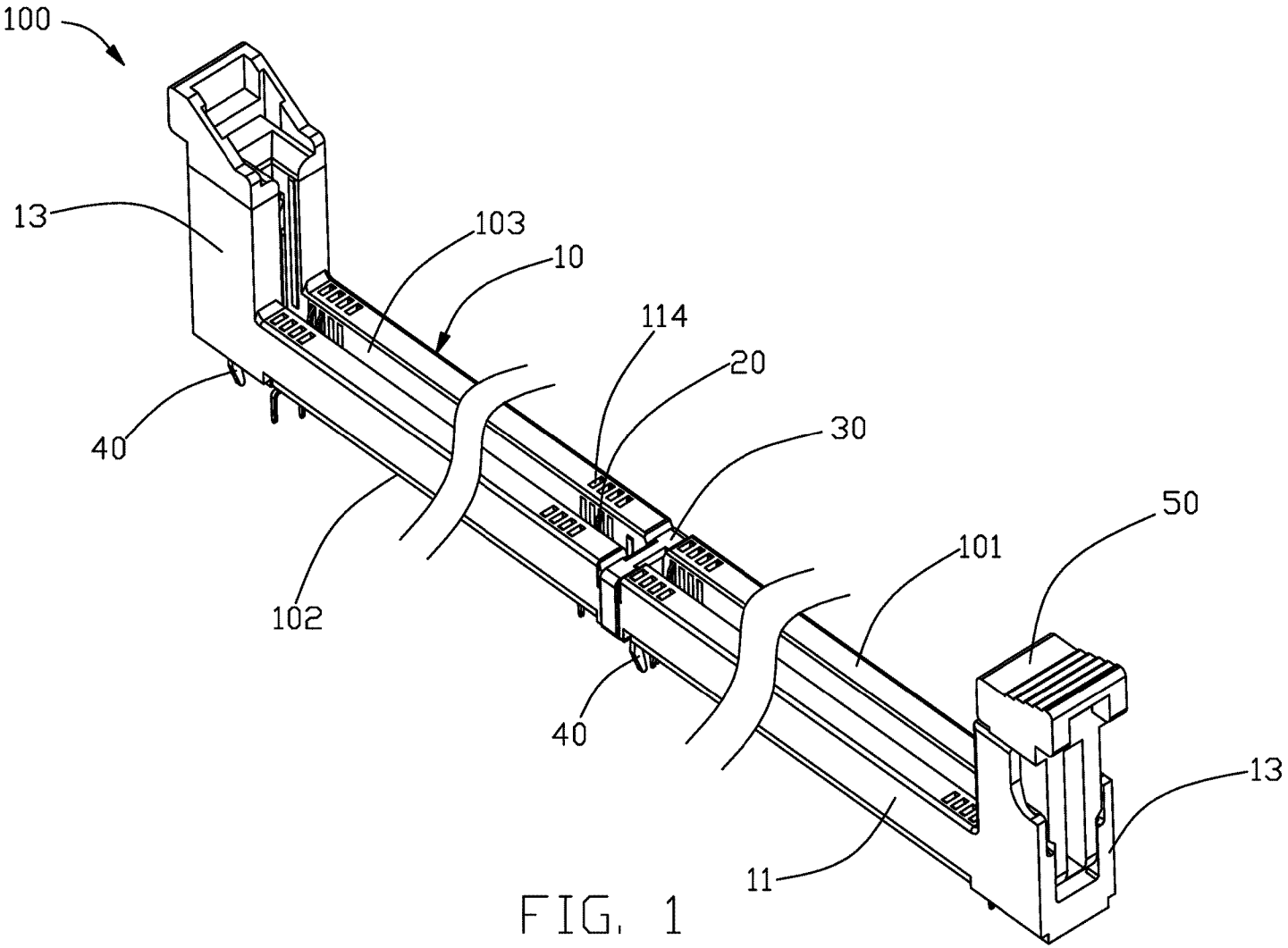
FIG. 1 is a perspective view of an electrical card edge connector according to the presently preferred embodiment of the invention.
Figure 2:
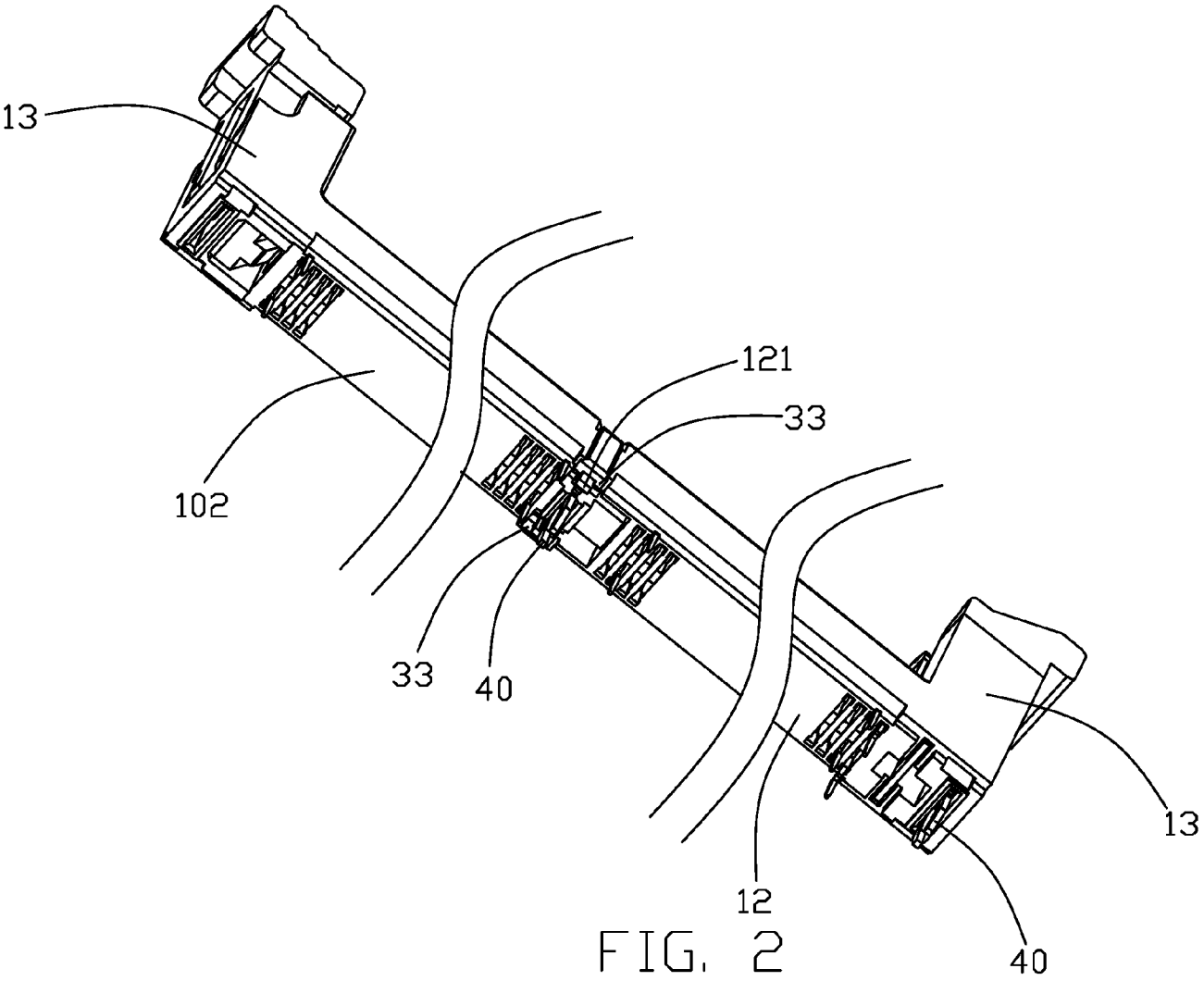
FIG. 2 is another perspective view of the electrical card edge connector of FIG. 1.
Figure 3:
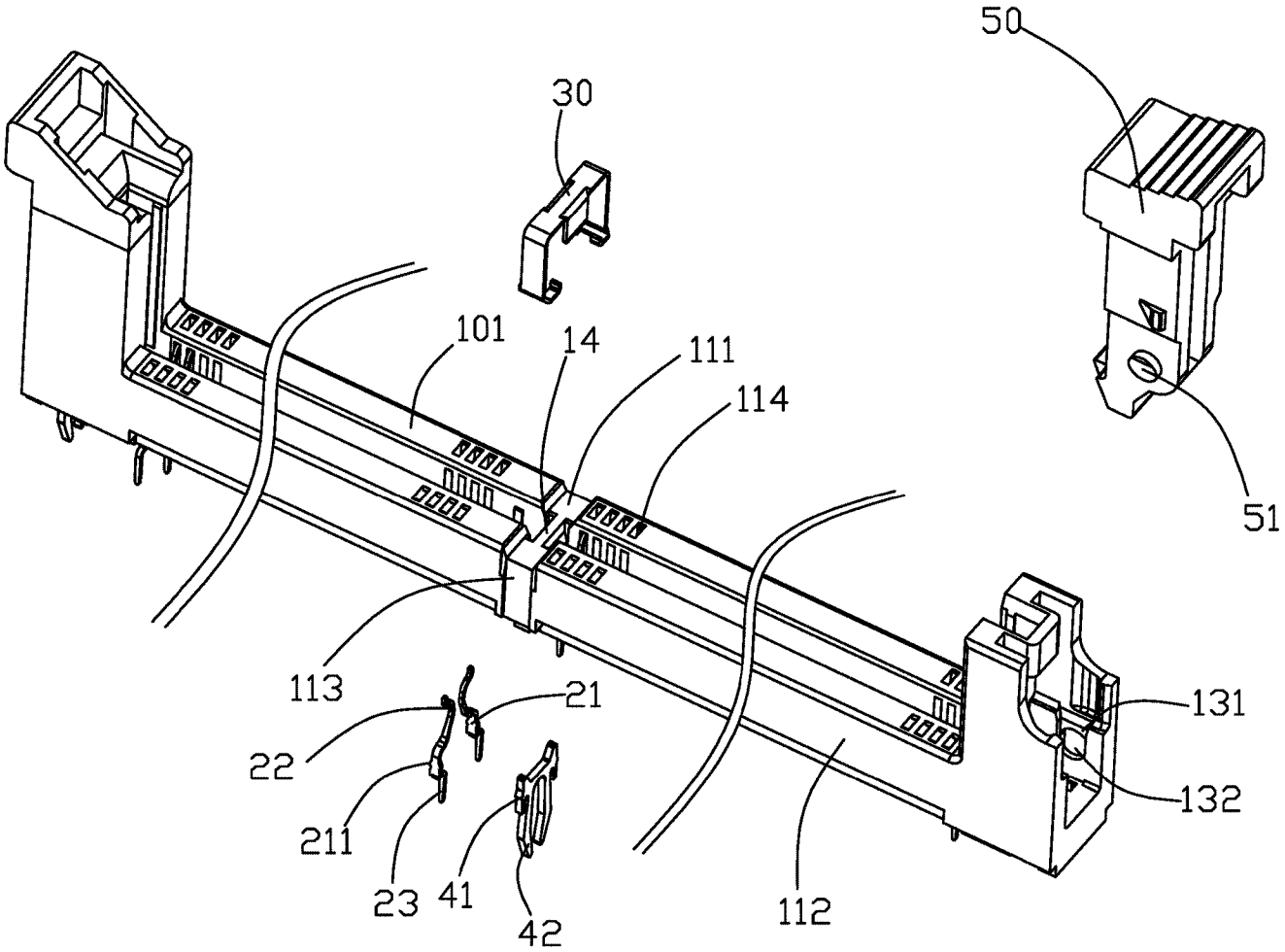
FIG. 3 is a partially exploded perspective view of the electrical card edge connector of FIG. 1.
Figure 4:
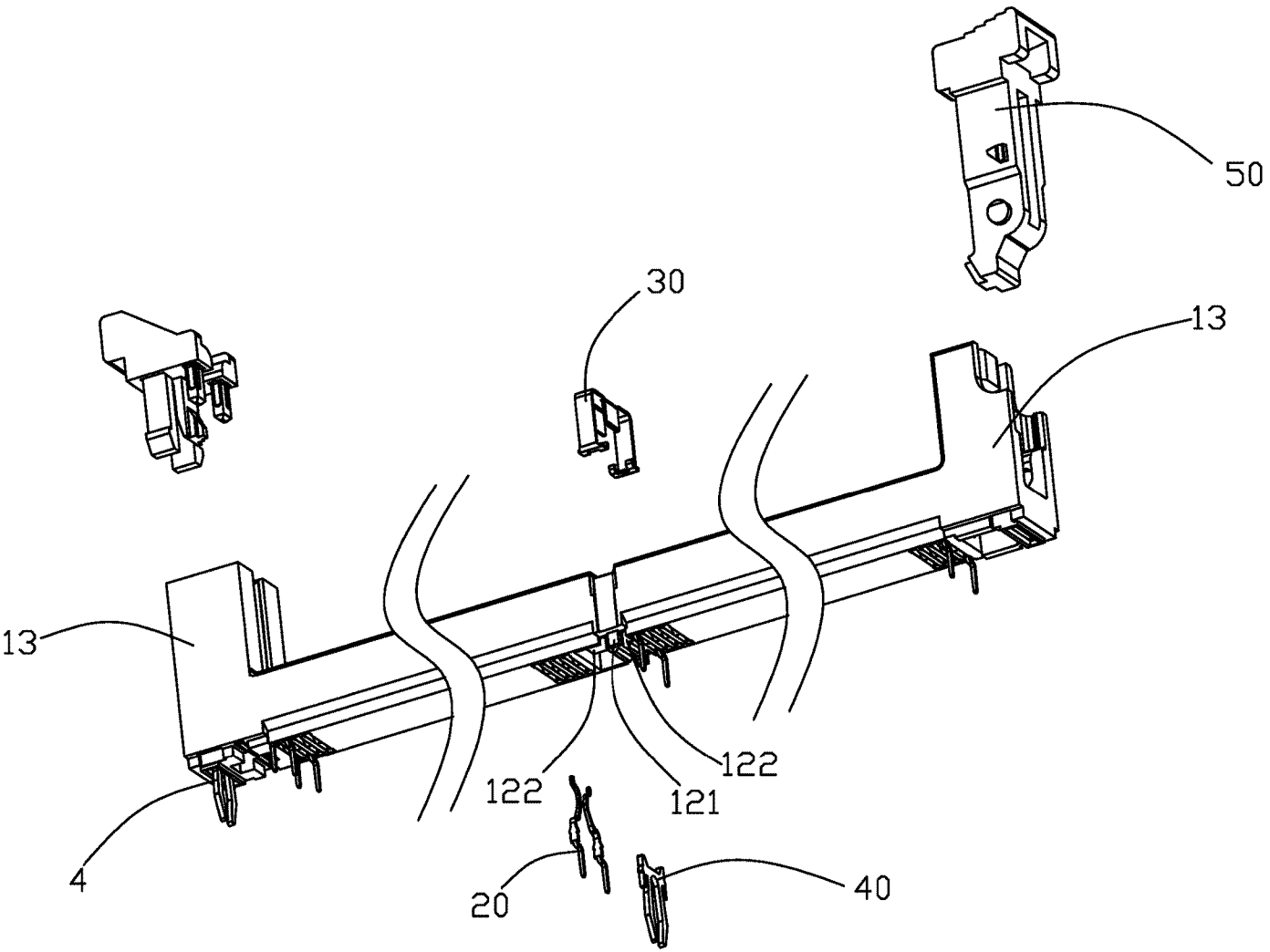
FIG. 4 is another partially exploded perspective view of the electrical card edge connector of FIG. 3.
Figure 5:
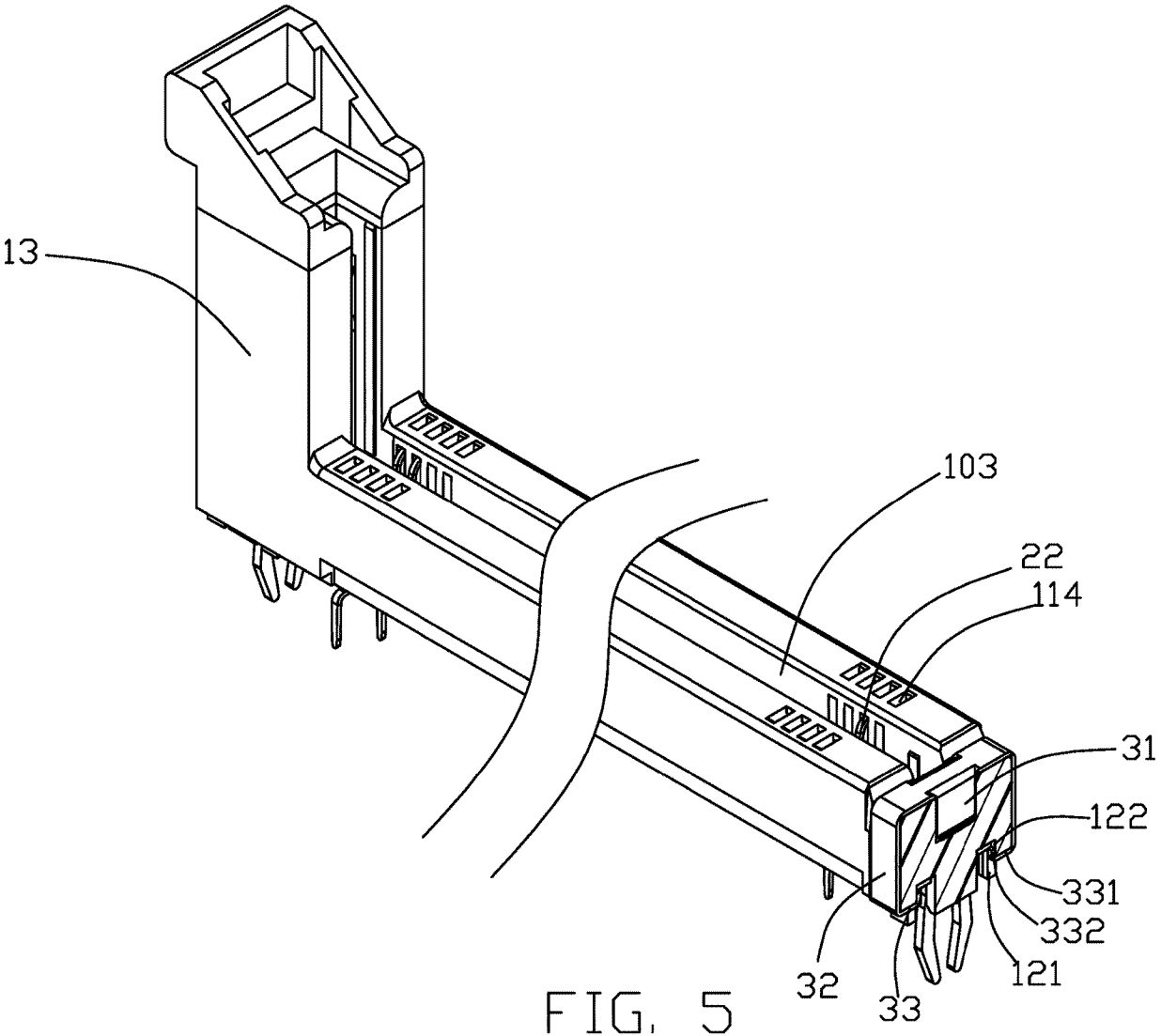
FIG. 5 is a partially cross-sectional perspective view of the electrical card edge connector of FIG. 3.
Figure 6:
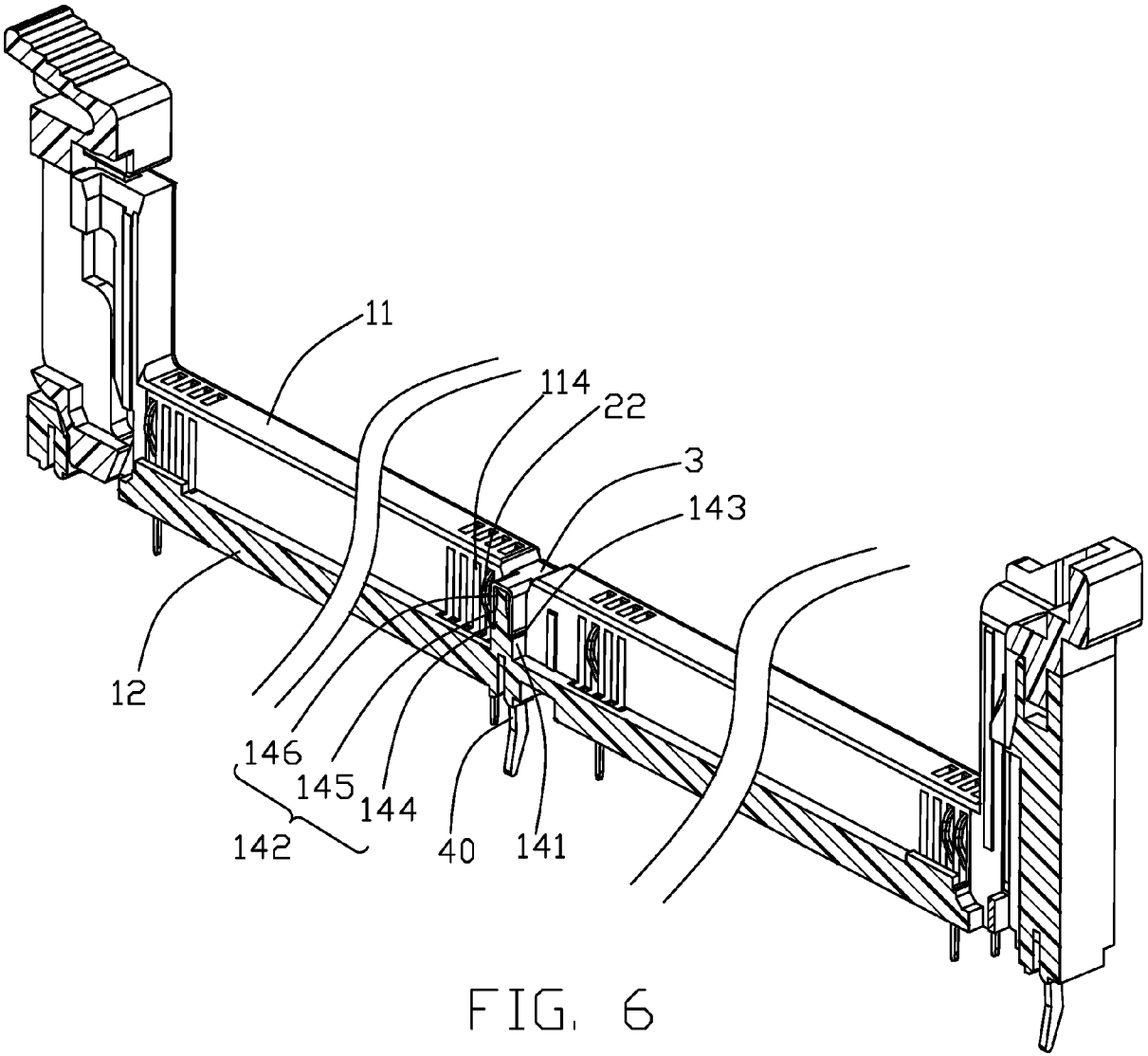
FIG. 6 is another partially cross-sectional perspective view of the electrical card edge connector of FIG. 3.
Figure 7:
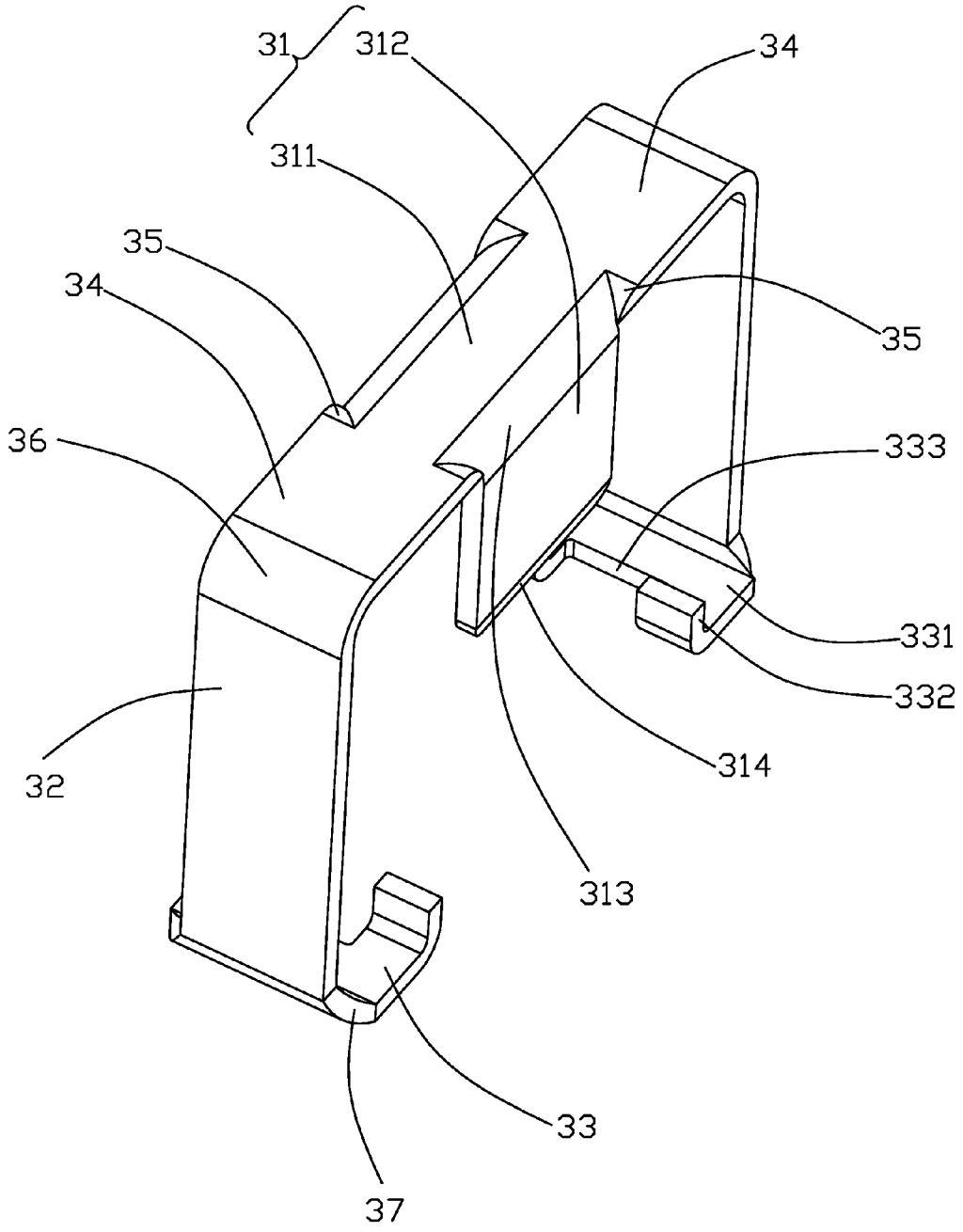
FIG. 7 is a perspective view of the alignment key of the electrical card edge connector of FIG. 1.
Figure 8:
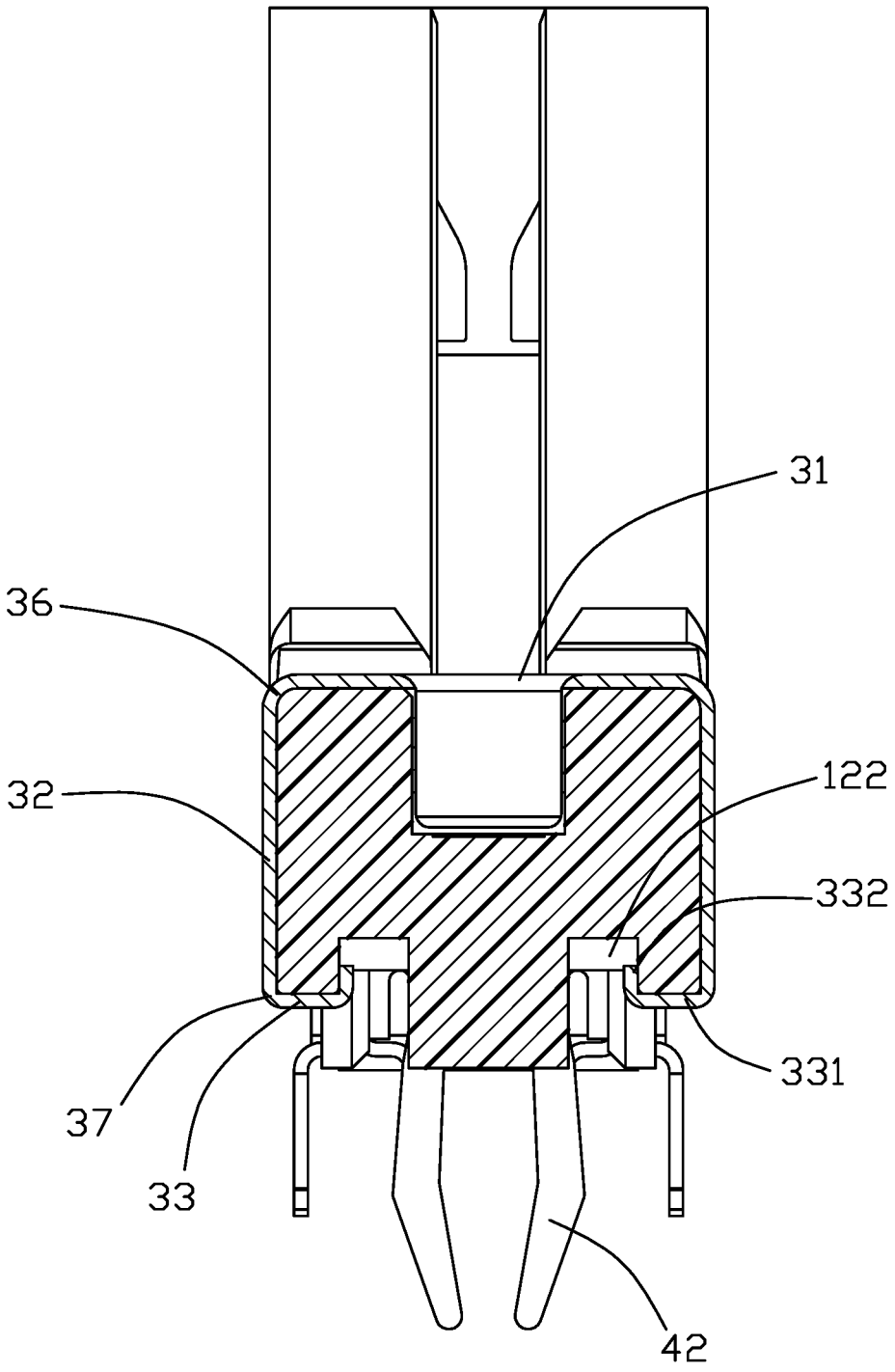
FIG. 8 is a cross-sectional view of the electrical card edge connector of FIG. 1.
Figure 9:
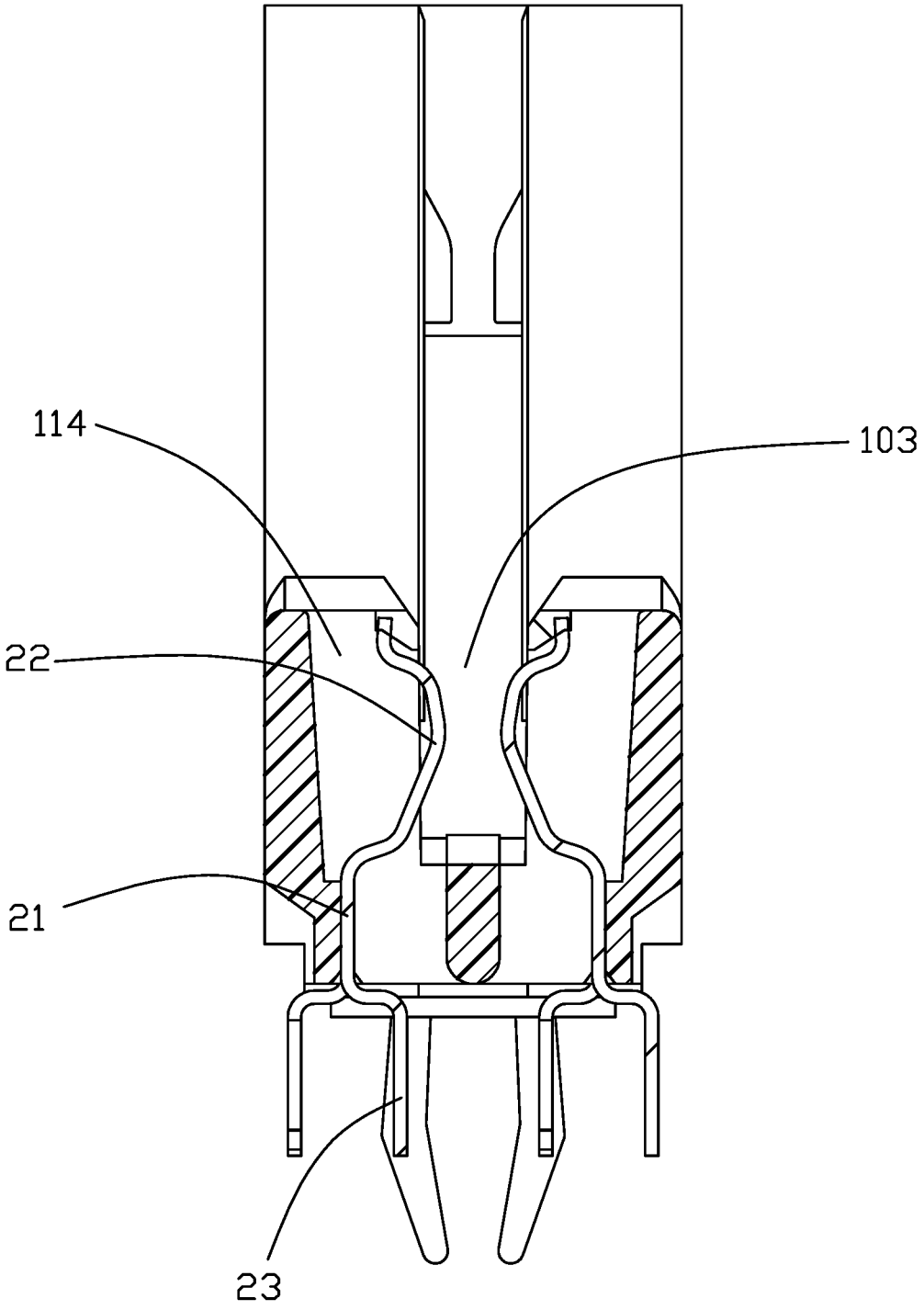
FIG. 9 is another cross-sectional view of the electrical card edge connector of FIG. 1.

Reference will now be made in detail to the preferred embodiment of the present invention.

Referring to FIGS. 1-9, an electrical card edge connector 100 for receiving an electronic card or memory module (not shown), includes an insulative housing 10, a plurality of terminals 20, an alignment key 30. a plurality of board locks 40 and a pair of ejectors 50.

The insulative housing 10 includes a mating face 101 and a mounting face 102 opposite to the mating face 101. The mating face 101 is essentially the top face of the housing 10, and the mounting face 102 is essentially the bottom face of the housing 10. A central slot 103 is formed in the housing 10 and recessed downwardly from the mating face 101. The housing 10 includes a pair of side walls 11, a bottom wall 12 connected to both the side walls 12, and a pair of towers 13 respectively located at two opposite ends of the housing 10 in the longitudinal direction. Each side wall 11 has a top recess 111 in the corresponding top face 101, and a side recess 113 in the side face 112 linked with the top recess 111. Each side wall 11 includes one row of terminal receiving passageways 114 extending therethrough in a vertical direction perpendicular to the longitudinal direction. The bottom wall 12 forms a pair of standoffs 121 and a pair of securing slots 122 located by each standoff 121.

The insulative body 10 includes a key seat 14 within the central s lot 103 and linked between the side walls 11. The key seat 14 is flush with the top recess 111 and lower than the mating face 101. The key seat 14 includes a main body 141 and a coupling section 142 extending upwardly from the main body 141. The main body 141 is linked with the corresponding side wall 11 and the coupling section 142 forms two key slots 143 in the side wall 11. The coupling section 142 forms a gradually thickened thickness in a vertical direction wherein the first coupling segment 144 and the third coupling segment 146 extend straightly while the second coupling segment 145 extends in a tapered manner.

Each tower 13 forms a rotation slot 131 to receive the corresponding ejector 50 wherein the ejector 50 includes a pivot shaft 51 received within the pivotal hole 132 in the rotation slot 13 for rotation of the ejector 50 in the rotation slot 131.

The terminals 20 are arranged with two rows respectively received within the corresponding passageway 114. Each terminal 20 includes a base 21 for retaining to the housing 10, a contacting section 22 extending from one end of the base 21 and into the central sot 103, and a mounting section 23 extending from the other end of the base 21 and located around the mounting face 102. The base 21 includes barbs 211 for retaining the terminal 20 within the passageway 114.

The discrete alignment key 30 is made by either plastic or metal. In other embodiments, the key seat 14 may be removed by replaced directly by the alignment key 30. The alignment key 30 includes the body 31 extending into the central slot 103, a pair of extension sections 32 covering the corresponding side wall 11, and a pair of securing sections 33 attached upon the bottom wall 12 for assuring reliable securing of the alignment key 30 to the hosing 10. In this embodiment, the securing sections 33 are pressed and riveted upon the bottom wall 12. The body 31 is applied upon the key seat 14 so as to have the body 31 aligned and received within the bottom notch of the electronic card (not shown). The body 31 includes a mating section 311 and the protection tabs 312 extending downwardly from two opposite sides of the mating section 311.

The alignment key 30 further includes a pair of horizontal regions 34 between the body 31 and the corresponding extension sections 32. The restraining slots 35 are formed between the body 31 and the horizontal regions 34. The horizontal region 34 are linked with the corresponding extension section 32 via a first curved region 36 while the extension section 32 are linked with the securing section 33 via a second curved region 37. The body 31 are linked with the mating section 311 via a third curved region 113. The protection tab 312 forms a tapered face 312 at the bottom.

The securing section 33 includes a gripping region 331 and a pair of securing legs 332 extending upwardly from the gripping region 331. A slot 333 is formed between the pair of securing legs 332, whereby the securing legs 332 are assembled into the corresponding securing slots 122 while the standoff 121 is received within the slot 333.

Figure 11:
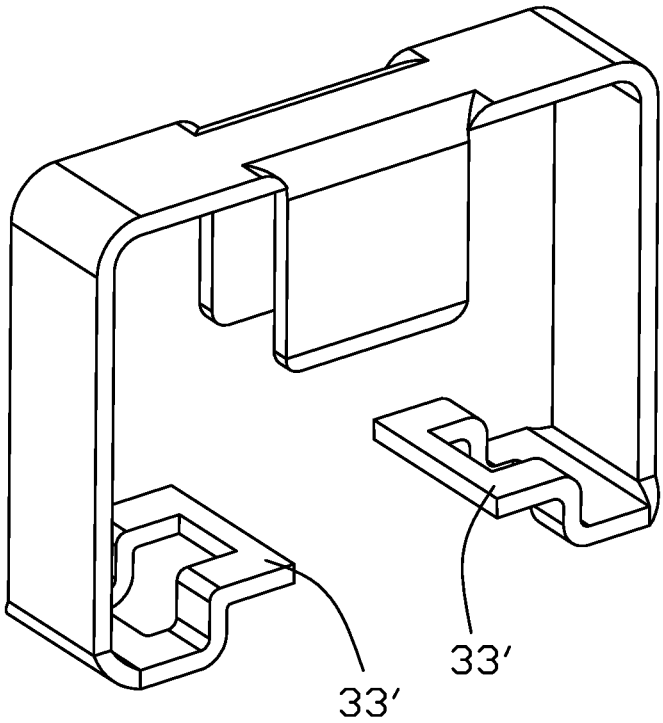
FIG. 11 is a perspective view of the alignment key of the electrical card edge connector according to a third embodiment of the invention.
Figure 12:
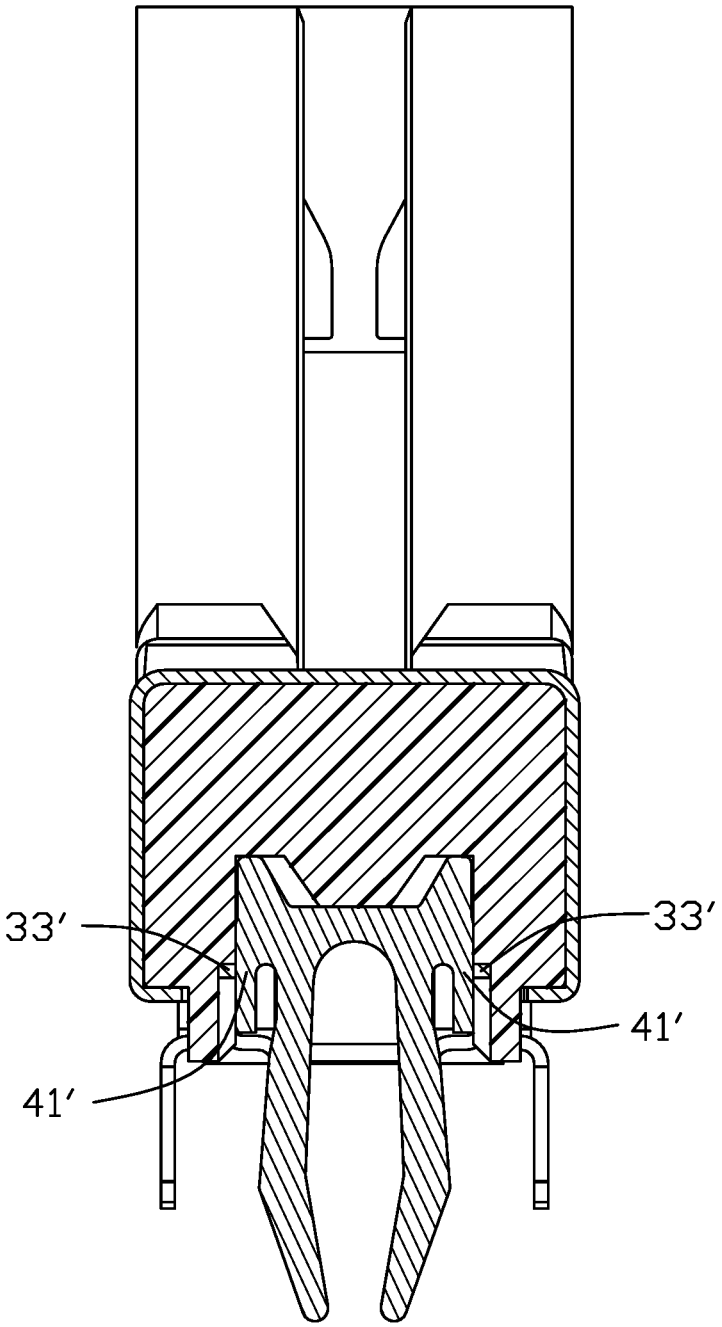
FIG. 12 is a cross-sectional view of the electrical card edge connector of FIG. 11.
Figure 13:
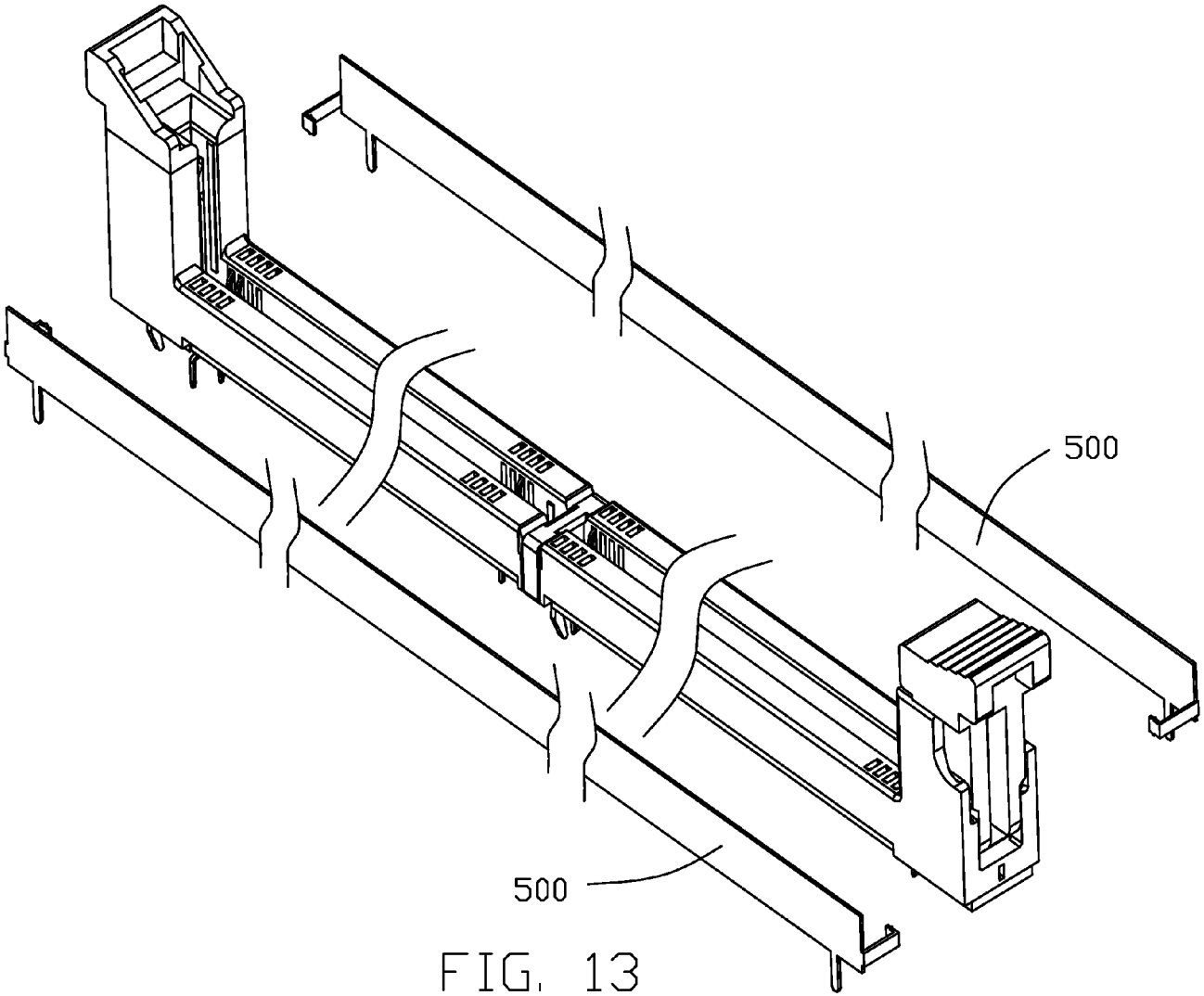
FIG. 13 is a perspective view of the electrical card edge connector according to a fourth embodiment of the invention.
Figure 14:
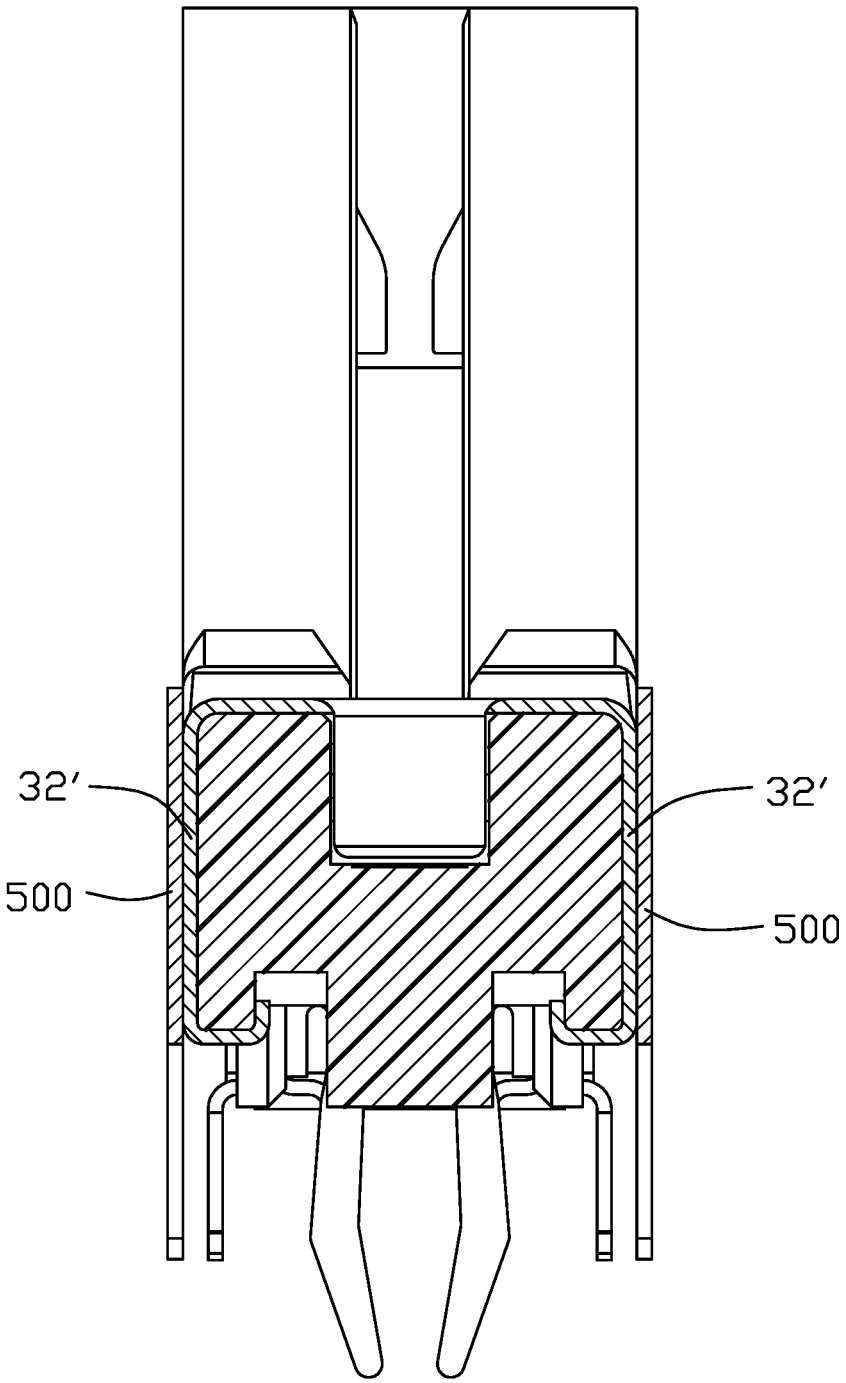
FIG. 14 is a cross-sectional view of the electrical card edge connector of FIG. 14.

The board lock 40 is made of metal and includes a fixing section 41 retained in the housing 10, and a pair of mounting legs 42 exposed upon the mounting face 102 wherein the mounting leg 42 of one board lock 40 is located between the securing sections 33 of the alignment key 30. In this embodiment, the board lock 40 is not mechanically and electrically connected to the alignment key 30. Anyhow, in the third embodiment as shown in FIGS. 11 and 12, the fixing sections 41' are electrically and mechanically connected to the securing section 33' for enhancing the grounding effect. In the fourth embodiment as shown in FIGS. 13 and 14, the extension sections 32' of the alignment key are mechanically and electrically connected to the metallic shell 500 which cover the corresponding side wall, thus resulting in a superior grounding effect. Notably, if properly arranged, the alignment key may be unitarily formed with the shell.

Figure 10:
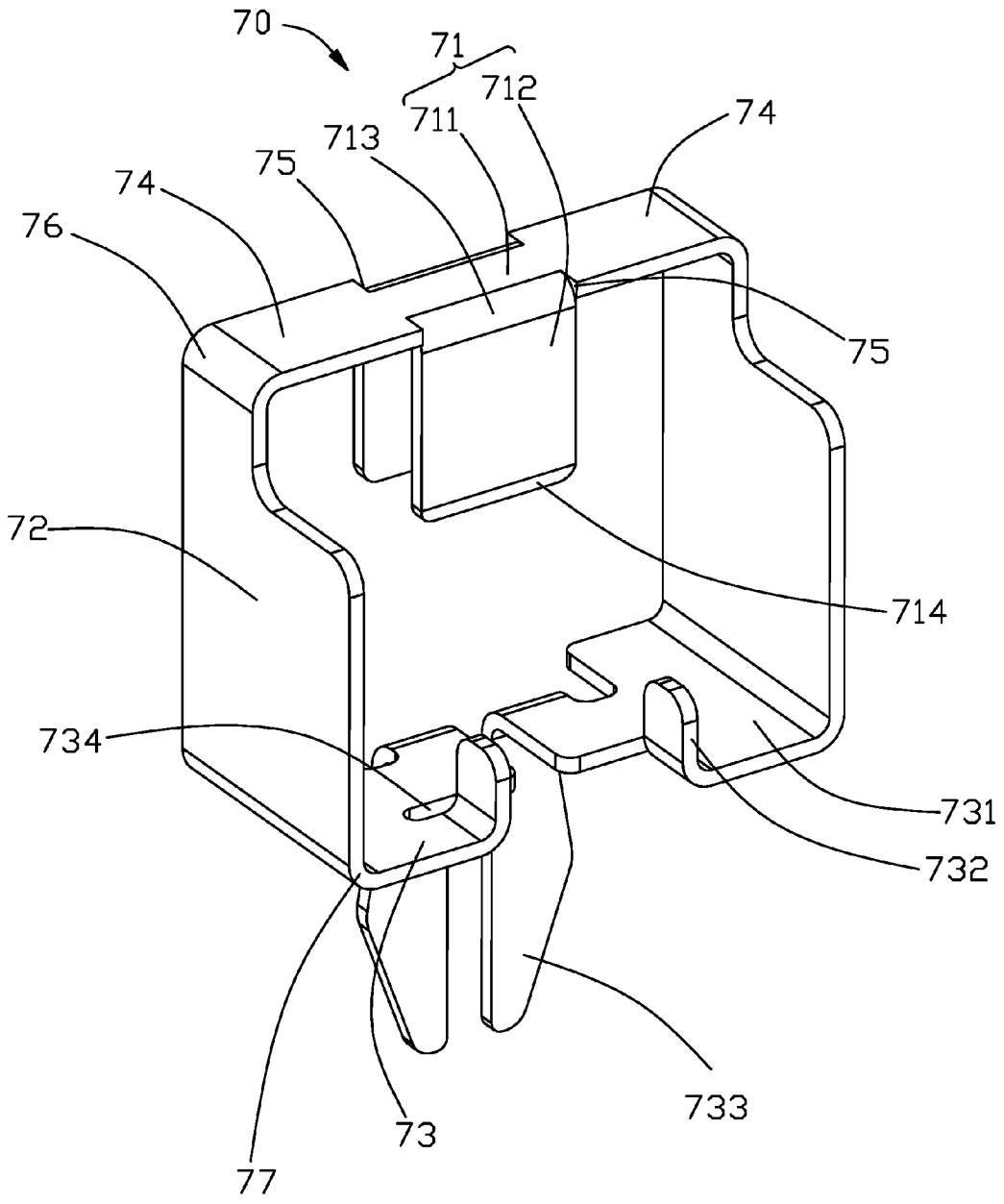
FIG. 10 is another perspective of the alignment key used in the electrical card edge connector according to a second embodiment of the invention.

In the second embodiment, as shown in FIG. 10 the alignment key 30 and the corresponding board lock 40 can be unitarily formed as one piece. A board lock 70 includes a body 71 received within the central slot 103, a pair of extension sections 72, and a pair of securing sections 73. Similar to the first embodiment, the body 71 includes the mating section 711 and the protection tabs 312 for engagement within the bottom notch of the electronic card (not shown).

The board lock 70 further includes the horizontal region 74 between the body 71 and the corresponding extension section 72 with the corresponding restraining slots 75. Similar to the first embodiment, a first curved region 76, a second curved region 77, a third curved region 713 and the tapered face 714 are formed on the board lock 70.

The securing section 73 includes a gripping region 731, an upward extending securing leg 732 for securing to the housing and a downwardly extending mounting leg 733 for mounting to the printed circuit board. A slit 734 is formed between the securing leg 732 and the gripping region 731.

However, the disclosure is illustrative only, changes may be made in detail, especially in matter of shape, size, and arrangement of sections within the principles of the invention.

What is claimed is:

1. An electrical card edge connector for mating with an electrical card, comprising:

an insulative elongated housing including a pair of side walls extending along a longitudinal direction and a central slot therebetween in a transverse direction perpendicular to said longitudinal direction, said housing further defining opposite top mating face and bottom mounting face in a vertical direction perpendicular to both said longitudinal direction and said transverse direction;

a plurality of terminals disposed in the two side walls with contacting sections extending into the central slot;

a metallic alignment key, for mating within a bottom notch in the electrical card, assembled to the housing and including a body disposed in the central slot, a pair of extension sections opposing to each other in the transverse direction to cover exterior surfaces of the corresponding side walls, and a pair of securing sections attached upon the mounting face of the housing and opposite to each other in the transverse direction, further including a metallic board lock located between the pair of securing sections in the transverse direction for mounting to a printed circuit board on which the housing is seated; wherein said board lock is mechanically and electrically connected to the pair of securing sections in the transverse direction.

2. The electrical card edge connector as claimed in claim 1, wherein said board lock is unitarily formed with the alignment key.

3. The electrical card edge connector as claimed in claim 1, wherein the securing section includes a gripping region extending inwardly from the corresponding extension section in the transverse direction, and a pair of securing legs upwardly extending from the gripping region.

4. The electrical card edge connector as claimed in claim 3, wherein said housing forms a pair of standoffs upon the mounting face, and each of said standoffs is located between the pair of securing legs in the longitudinal direction.

5. The electrical card edge connector as claimed in claim 4, wherein the board lock is located between the pair of standoffs in the transverse direction.

6. The electrical card edge connector as claimed in claim 1, wherein said housing includes in the central slot a key seat on which the alignment key is attached.

7. The electrical card edge connector as claimed in claim 1, further includes a metallic shell covering the corresponding side walls and the extension sections in the transverse direction.

8. The electrical card edge connector as claimed in claim 1, wherein said housing forms recesses in exterior surfaces to receive the alignment key therein.

9. An electrical card edge connector for mating with an electrical card, comprising:

an insulative elongated housing including a pair of side walls extending along a longitudinal direction and a central slot therebetween in a transverse direction perpendicular to said longitudinal direction, said housing further defining opposite top mating face and bottom mounting face in a vertical direction perpendicular to both said longitudinal direction and said transverse direction;

a plurality of terminals disposed in the two side walls with contacting sections extending into the central slot; and a metallic alignment key, for mating within a bottom notch in the electrical card, assembled to the housing and including a body disposed in the central slot, a pair of vertically extending extension sections opposing to each other in the transverse, and a pair of securing sections attached upon the bottom face of the housing and opposite to each other in the transverse direction; wherein a metallic board lock is mounted to the mounting face between the pair of securing sections in the transverse direction; wherein the housing forms in the central slot a key seat on which the alignment key is positioned; wherein the housing forms a pair of standoffs on the mounting face, and the board lock is located between the pair of standoffs in the transverse direction.

10. The electrical card edge connector as claimed in claim 9, wherein the securing section forms a slot to receive the corresponding standoff therein.

11. The electrical card edge connector as claimed in claim 9, wherein said board lock is electrically and mechanically connected to the securing sections.

12. An electrical card edge connector for mating with an electrical card, comprising:

an insulative elongated housing including a pair of side walls extending along a longitudinal direction and a central slot therebetween in a transverse direction perpendicular to said longitudinal direction, said housing further defining opposite top mating face and bottom mounting face in a vertical direction perpendicular to both said longitudinal direction and said transverse direction;

a plurality of terminals disposed in the two side walls with contacting sections extending into the central slot;

a metallic alignment key, for mating within a bottom notch in the electrical card, assembled to the housing and including a body disposed in the central slot, a pair of extension sections opposing to each other in the transverse direction to cover exterior surfaces of the corresponding side walls, and a pair of securing sections attached upon the mounting face of the housing and opposite to each other in the transverse direction; wherein the securing section includes a gripping region extending inwardly from the corresponding extension section in the transverse direction, and a pair of securing legs upwardly extending from the gripping region.

13. The electrical card edge connector as claimed in claim 12, wherein said housing forms a pair of standoffs upon the mounting face, and each of said standoffs is located between the pair of securing legs in the longitudinal direction.

14. The electrical card edge connector as claimed in claim 13, wherein the board lock is located between the pair of standoffs in the transverse direction.

* * * * *